US006380790B1

(12) United States Patent
Denison

(10) Patent No.: US 6,380,790 B1
(45) Date of Patent: Apr. 30, 2002

(54) INTEGRATOR TOPPLOGY FOR CONTINUOUS INTEGRATION

(75) Inventor: Timothy J. Denison, Andover, MA (US)

(73) Assignee: President and Fellows of Harvard College, Cambridge, MA (US)

( * ) Notice: Subject to any disclaimer, the term of this patent is extended or adjusted under 35 U.S.C. 154(b) by 0 days.

(21) Appl. No.: 09/502,134

(22) Filed: Feb. 11, 2000

(51) Int. Cl.[7] ..... G06G 7/18
(52) U.S. Cl. ..... 327/344; 327/345
(58) Field of Search ..... 327/100, 334, 327/336, 337, 344, 345

(56) References Cited

U.S. PATENT DOCUMENTS

| | | | | | |
|---|---|---|---|---|---|
| 4,727,330 | A | * | 2/1988 | Funk | 324/445 |
| 4,764,752 | A | * | 8/1988 | Ormand | 327/307 |
| 4,816,745 | A | * | 3/1989 | Schneider | 324/62 |
| 4,837,527 | A | | 6/1989 | Sauer | 332/11 D |
| 5,083,091 | A | * | 1/1992 | Frick et al. | 324/678 |
| 5,113,085 | A | * | 5/1992 | Schafer et al. | 327/398 |
| 5,550,498 | A | * | 8/1996 | Kwan et al. | 327/304 |
| 6,084,450 | A | * | 7/2000 | Smith et al. | 327/172 |

OTHER PUBLICATIONS

Enz et al., "Circuit Techniques for Reducing the Effects of Op–Amp Imperfections: Autozeroing, Correlated Double Sampling, and Chopper Stabilization," *Proceedings of the IEEE*, vol. 84, No. 11, pp. 1584–1614, Nov. 1996.

Sigworth, "Electronic Desigh of the Patch Clamp,"Chaper 1, pp. 3–34, from *Single–Channel Recording, 2nd* Edition, Sakmann and Neher, Editors, Plenum Press, New York, New York, 1995.

Denison et al., "A New Integrating Patch Clamp Amplifier Eliminates Discontinuous 'Resets'," Abstracts of the Biophysical Society 44th Annual Meeting, *Biophysical Journal*, vol. 78, No. 1, Part 2 of 2, p. 267A, Jan. 2000.

* cited by examiner

*Primary Examiner*—Kenneth B. Wells
(74) *Attorney, Agent, or Firm*—Theresa A. Lober

(57) ABSTRACT

An apparatus includes a switching circuit, an integrator circuit having an input for receiving a first signal from the switching circuit, a sensing circuit having an input for receiving a second signal from the integrator circuit, and a control circuit having an input for receiving a third signal from the sensing circuit and an output for sending a fourth signal to the switching circuit. In certain applications, the integrator circuit includes a first integrator and a second integrator having an inverting terminal connected to an inverting terminal of the first integrator. The second integrator also includes a non-inverting terminal connected to an output of the first integrator through a first capacitor, and an output connected to a non-inverting terminal of the first integrator through a second capacitor.

25 Claims, 17 Drawing Sheets

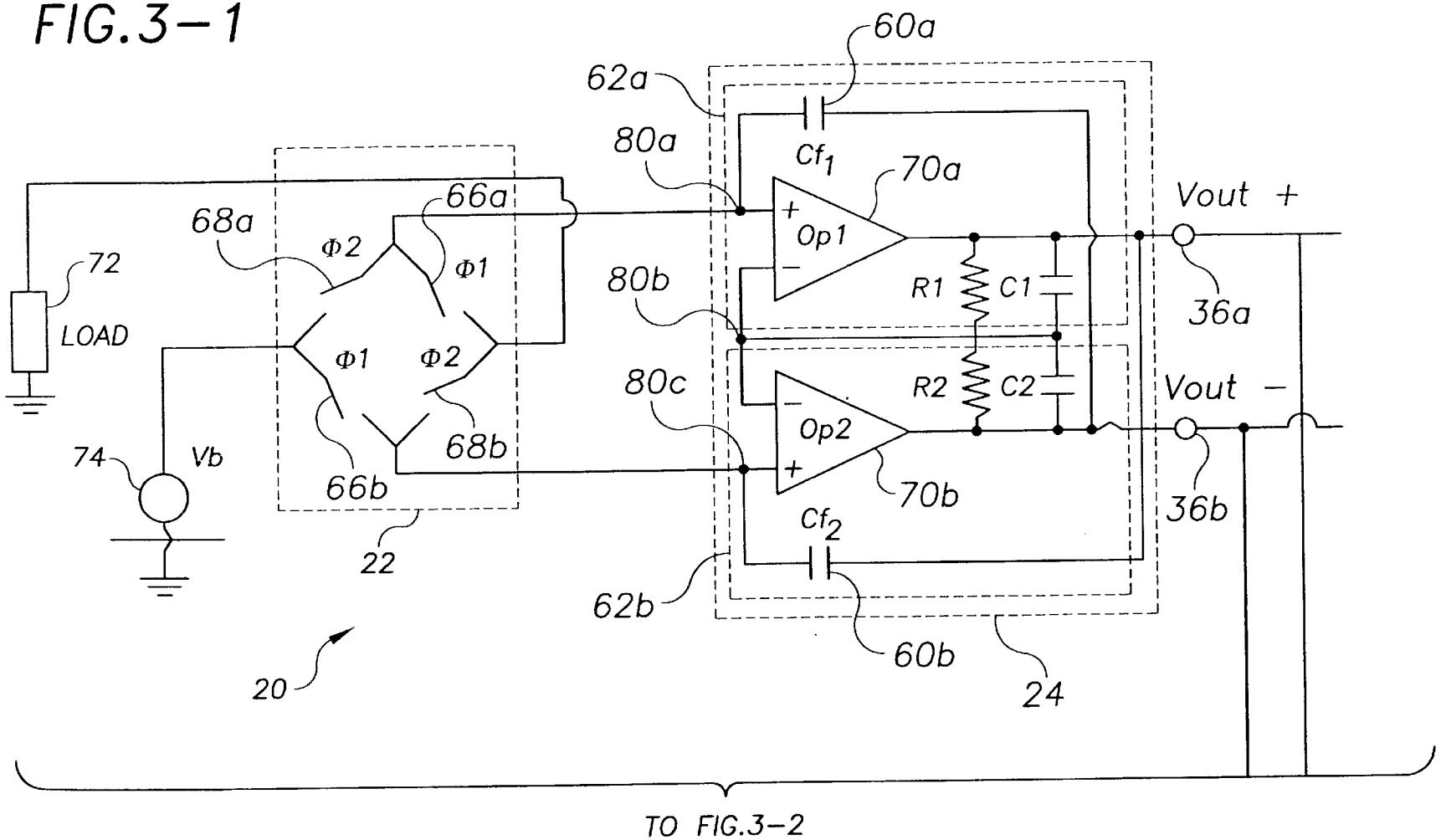
FIG.3−1

INTEGRATOR TOPPLOGY FOR CONTINUOUS INTEGRATION

BACKGROUND

This invention relates to integrators.

Integrators have high linearity, wide bandwidth, and low noise characteristics. Integrators, however, require a reset interval to discharge the capacitor in the integrator's feedback loop which results in significant "dead" times in measurements and harmful transients on the integrator's input. Additionally, the rapid discharge interval aggravates the problem of dielectric absorption, thereby undermining the lower limit of instrument precision.

Referring to FIG. 1, an integrator 10 includes a feedback loop having a switch 12 in parallel with a feedback capacitor 14. The switch 12 allows the feedback capacitor 14 to discharge when the switch 12 is closed. Placing one or more strings of series resistors and capacitors in parallel with the feedback capacitor 14 with or without the switch 12 reduces at least some of the harmful effects of this discharge. However, even in some arrangements having multiple capacitors, dielectric absorption is still a problem since the charge in the series capacitors is redistributed with the feedback capacitor 14.

SUMMARY

In one general aspect of the invention, an apparatus includes a switching circuit, an integrator circuit having a first input for receiving a first signal from the switching circuit, a sensing circuit having a second input for receiving a second signal from the integrator circuit, and a control circuit having an input for receiving a third signal from the sensing circuit and an output for sending a fourth signal to the switching circuit.

Embodiments of this aspect of the invention may include one or more of the following features. The switching circuit includes two sets of two switches (e.g., MOS devices), the two switches in one set being closed when the two switches in the other set are open.

The integrator circuit includes a first integrator and a second integrator having connected inverting terminals. Each of the first integrator and the second integrator have a non-inverting terminal connected to an output of the switching circuit. Each integrator also has an output connected to the non-inverting terminal of the other integrator through a capacitor.

In operation, the first integrator and the second integrator have voltages on respective ones of the inverting and non-inverting terminals which are substantially equal and have output voltages which are complementary.

The apparatus can be used in a wide variety of applications in which low level, precise measurements are required. For example, in one biological application, the first integrator and the second integrator are operated to each introduce an output voltage into a chemical bath on either side of a biological membrane. In this application, the integrator circuit is configured to detect fluctuations of ion channels. In another application, the integrator circuit may be configured for charge detection.

The sensing circuit includes two comparators, each comparator having an inverting terminal connected to the output of an integrator in the integrator circuit and each comparator having a non-inverting terminal for receiving a threshold voltage.

The control circuit includes a D-type flip-flop and a NAND gate having an output connected to a clock terminal of the D-type flip-flop. The NAND gate includes a pair of inputs, each connected to an output of a comparator in the sensing circuit.

In this embodiment, the sensing circuit includes an output connected to the D-type flip-flop to change the state of the D-type flip-flop. The D-type flip-flop includes high and low outputs which correspond to two switching positions of switches in the switching circuit.

The apparatus further includes a differentiator circuit having a fourth input for receiving a fifth signal from the integrator circuit and a fifth input for receiving a sixth signal from the control circuit.

The differentiator circuit includes an inverting terminal and a non-inverting terminal, each connected to an output of one of two integrators in the integrator circuit. In operation, the differentiator circuit receives the complementary voltages output by the integrator circuit and provides a demodulated differentiation bit stream representing the slope of the complementary voltages.

Where a differentiator circuit is used, the control circuit provides the sixth signal which determines which output of which integrator in the integrator circuit that each inverting and non-inverting terminal is connected to.

Among other advantages, the apparatus serves as a chopper stabilizer circuit that minimizes the need for rapid discharging of feedback capacitors in the integrator circuit. This feature is provided by alternating the signal current from the switching circuit to the integrator circuit. Thus, the integrator circuit is allowed to perpetually integrate these incoming current signals (low-level transducer signals) and output a continuous flow of two complementary voltages. In one mode of operation, the sensing circuit detects when one of the complementary voltages reaches a threshold value and notifies the control circuit. The control circuit then responds by sending a signal to the switching circuit. This signal changes the position of switches in the switching circuit, thereby alternating the signal current to the integrator circuit.

In summary, the apparatus eliminates dead time and input transients, compensates for charge injection at the input, and reduces the harmful effects of dielectric absorption. At the same time, the apparatus maintains high linearity, low noise, and wide bandwidth.

In another aspect of the invention, an integrator circuit includes a first integrator and a second integrator having an inverting terminal connected to an inverting terminal of the first integrator. The second integrator also includes a non-inverting terminal connected to an output of the first integrator through a first capacitor, and an output connected to a non-inverting terminal of the first integrator through a second capacitor.

In still another aspect of the invention, a differentiator circuit includes a first input for receiving one of a first signal or a second signal; a second input for receiving the other of the first signal or the second signal; and a third input for receiving a third signal. The third signal determines which of the first input or second input receives the first signal and which of the first input or second input receives the second signal.

Embodiments of this aspect of the invention may include one or more of the following additional features. The first and second signals are complementary voltage signals. The first input and the second input are each connected to an output of an integrator. The third signal includes an output of a control circuit.

The details of one or more embodiments of the invention are set forth in the accompanying drawings and the description below. Other features, objects, and advantages of the invention will be apparent from the description and drawings, and from the claims.

DETAILED DESCRIPTION

Figure 1:
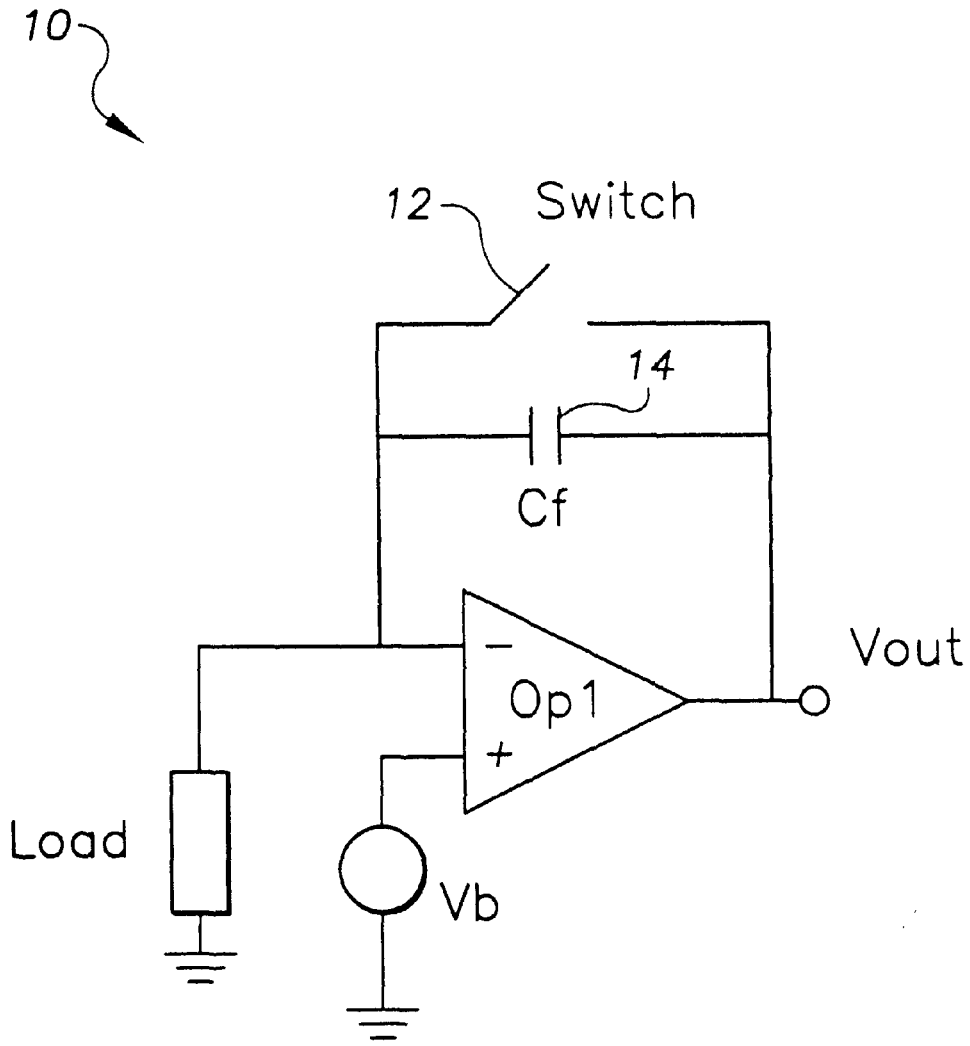
FIG. 1 PRIOR ART
FIG. 1 is a schematic diagram of a conventional integrator.
Figure 2:
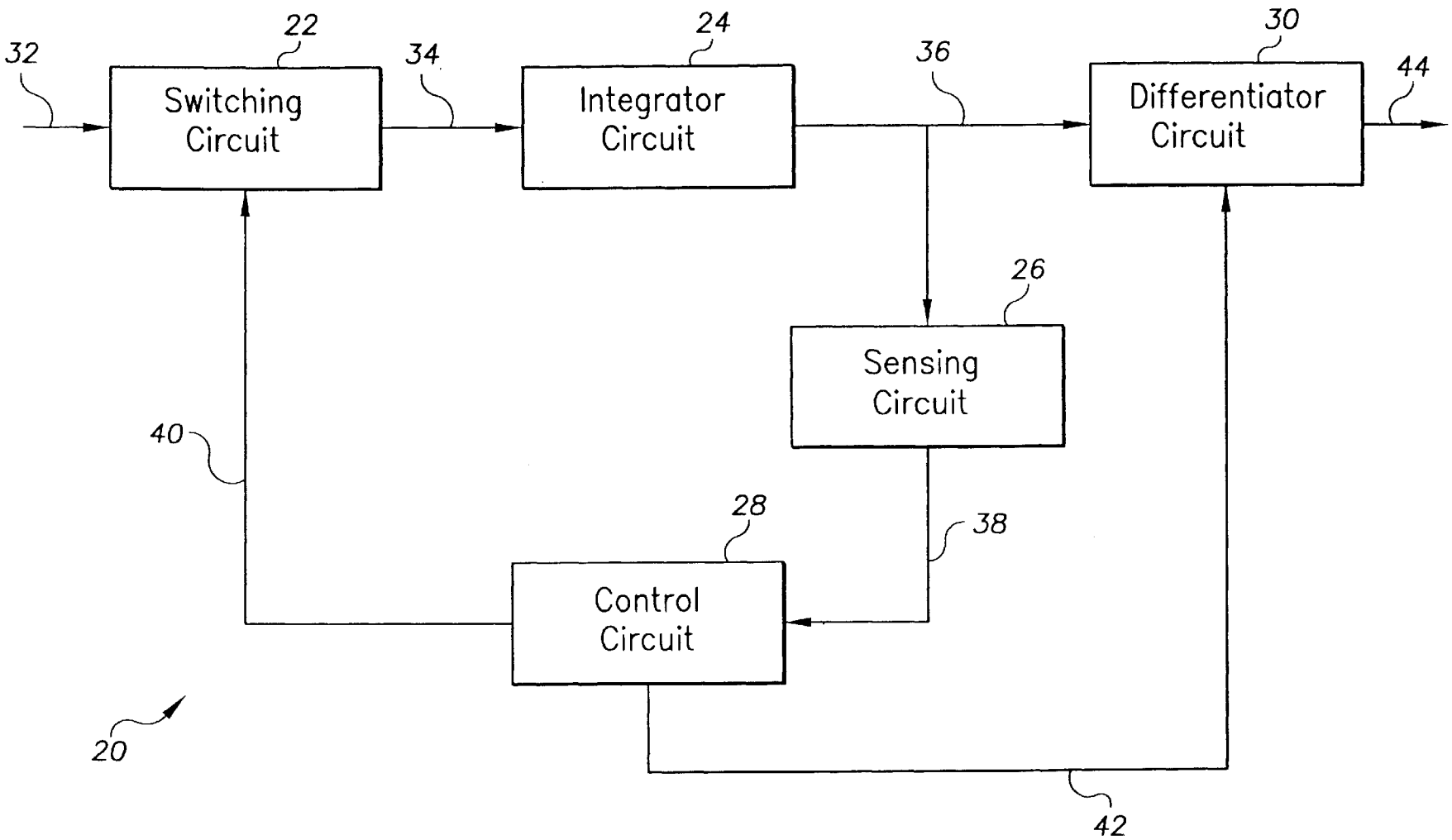
FIG. 2 is a block diagram of a chopper stabilizing circuit.

Referring to FIG. 2, a chopper stabilizing circuit 20 includes a switching circuit 22, an integrator circuit 24, a sensing circuit 26, a control circuit 28, and a differentiator circuit 30. In general, the chopper stabilizing circuit 20 has a topology and is controlled in a manner that eliminates the need for rapid discharging of feedback capacitors in the integrator circuit 24. In particular, and as will be discussed in greater detail below, this advantage is accomplished by alternating the signal current from the switching circuit 22 to the integrator circuit 24. In this way, the integrator circuit 24 can perpetually integrate these incoming current signals (low-level transducer signals) and output a continuous flow of two complementary voltages. The sensing circuit 26 detects when one of the complementary voltages reaches a threshold value and notifies the control circuit 28. The control circuit 28 responds by sending a signal to the switching circuit 22. This signal changes the position of switches in the switching circuit 22, thereby alternating the signal current to the integrator circuit 24. The differentiator circuit 30 receives the complementary voltages output by the integrator circuit 24 and provides a demodulated differentiation bit stream representing the slope of the complementary voltages. As will be described in more detail below, this chopper stabilizing circuit 20 eliminates dead time and input transients, compensates for charge injection at the input, and reduces the harmful effects of dielectric absorption. At the same time, the chopper stabilizing circuit 20 maintains high linearity, low noise, and wide bandwidth.

In the layout of the chopper stabilizing circuit 20, the switching circuit 22 has an input at a first node 32 for receiving an input signal. The input signal includes the driving current/voltage for the chopper stabilizing circuit 20 from a load, a current source, and/or a voltage source. The switching circuit 22 has an output at a second node 34 that is determined by the position of the switch(es) included in the switching circuit 22. The integrator circuit 24 has an input at the second node 34 for receiving an input signal from the switching circuit 22 and an output at a third node 36. The sensing circuit 26 has an input at the third node 36 for receiving an input signal from the integrator circuit 24 and an output at a fourth node 38. The control circuit 28 has an input at the fourth node 38 for receiving an input signal from the sensing circuit 26 and output at a fifth node 40 and a sixth node 42. The switching circuit 22 has an input for receiving an input signal from the control circuit 28 at the fifth node 40. This input signal controls the position of the switch(es) in the switching circuit 22.

The differentiator 30 is shown in FIG. 2, though its presence is not necessary to ensure proper functioning of the chopper stabilizing circuit 20. If it is not present, the integrator circuit 24 and the control circuit 28 may not necessarily have outputs at the third node 36 and the sixth node 42, respectively. The differentiator circuit 30 has an input at the third node 36 for receiving an input signal from the integrator circuit 24 and at the sixth node 42 for receiving an input signal from the control circuit 28. The input signal at the sixth node 42 controls the switch(es) included in the differentiator circuit 30. The differentiator also has an output at a seventh node 44.

Figures 2, 3:
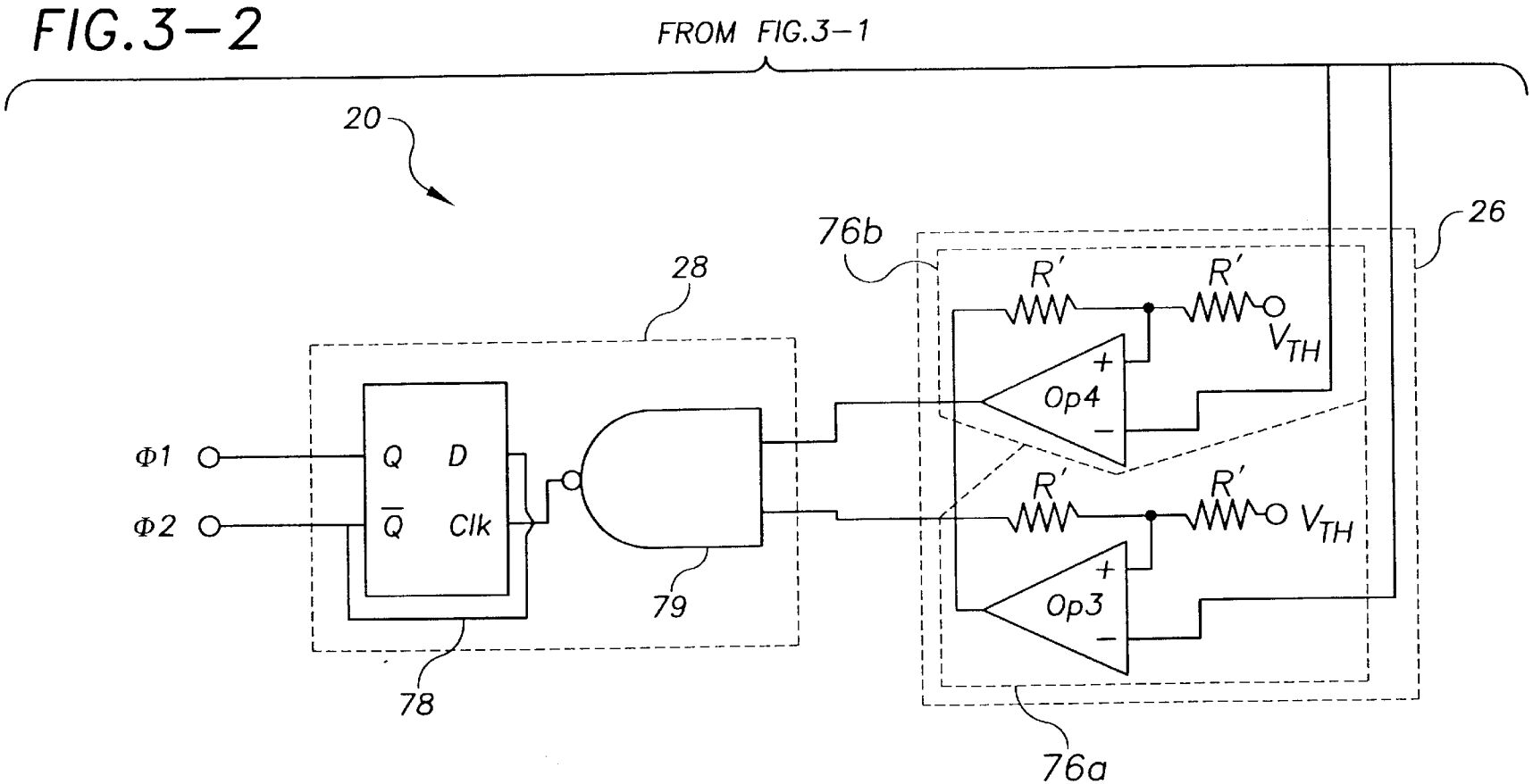
FIG. 3 is a schematic diagram of the block diagram of FIG. 2.

Referring to FIG. 3, one particular embodiment of a chopper stabilizing circuit 20 includes a switching circuit 22, an integrator circuit 24, a sensing circuit 26, and a control circuit 28. The chopper stabilizing circuit 20 eliminates the need for rapid discharging of feedback capacitors 60*a–b* (preferably Teflon®) in the integrator circuit 24 by alternating the signal current from the switching circuit 22 to two integrators 62*a–b* included in the integrator circuit 24. In this way, one feedback capacitor discharges while the other charges, thereby providing two inversely related output voltages (Vout+, Vout−) at Vout nodes 36*a–b*. Once either of the output voltages reaches a predetermined threshold value (Vth), a regenerative comparator 76*a–b* included in the sensing circuit 26 and connected to this output voltage is tripped. Hysteresis prevents the sensing circuit 26 from causing false resets. The comparator 76*a–b* triggers a D-type flip-flop 78 through a NAND gate 79, both included in the control circuit 28. As the flip-flop 78 changes state, the outputs Q and Q-bar connected to the switches 66*a–b*, 68*a–b* cause them to reverse position. This reversal preserves the same orientation with respect to the load 72, maintaining a uniform bias, while alternating the signal current to the integrator circuit 24.

More specifically, the switching circuit 22 includes two pairs of two symmetric switches 66*a–b*, 68*a–b*. The switches 66*a–b*, 68*a–b* may be any type of standard MOS (metal oxide semiconductor) switch, e.g., MAXIM 326. Only one set of switches 66*a–b*, 68*a–b* is closed at a time, each closed switch providing a path for a signal to the non-inverting input terminal of an operational amplifier (opamp) 70*a–b*, e.g., Burr-Brown OP627, included in the integrators 62*a–b*. When the phase one (Φ1) switches 66*a–b* are closed, a load 72 provides the input current (Io) to the first opamp 70*a* while a voltage source 74 provides the bias voltage (Vb) to the second opamp 70*b*. When the phase two (Φ2) switches are closed, the load 72 and the voltage source 74 provide current/voltage to the other opamp 70*a–b*. The values of Vout+ at the Vout node 36*a* and Vout− at the Vout node 36*b* depend on the position of these switches 66*a–b*, 68*a–b*.

Figure 4:
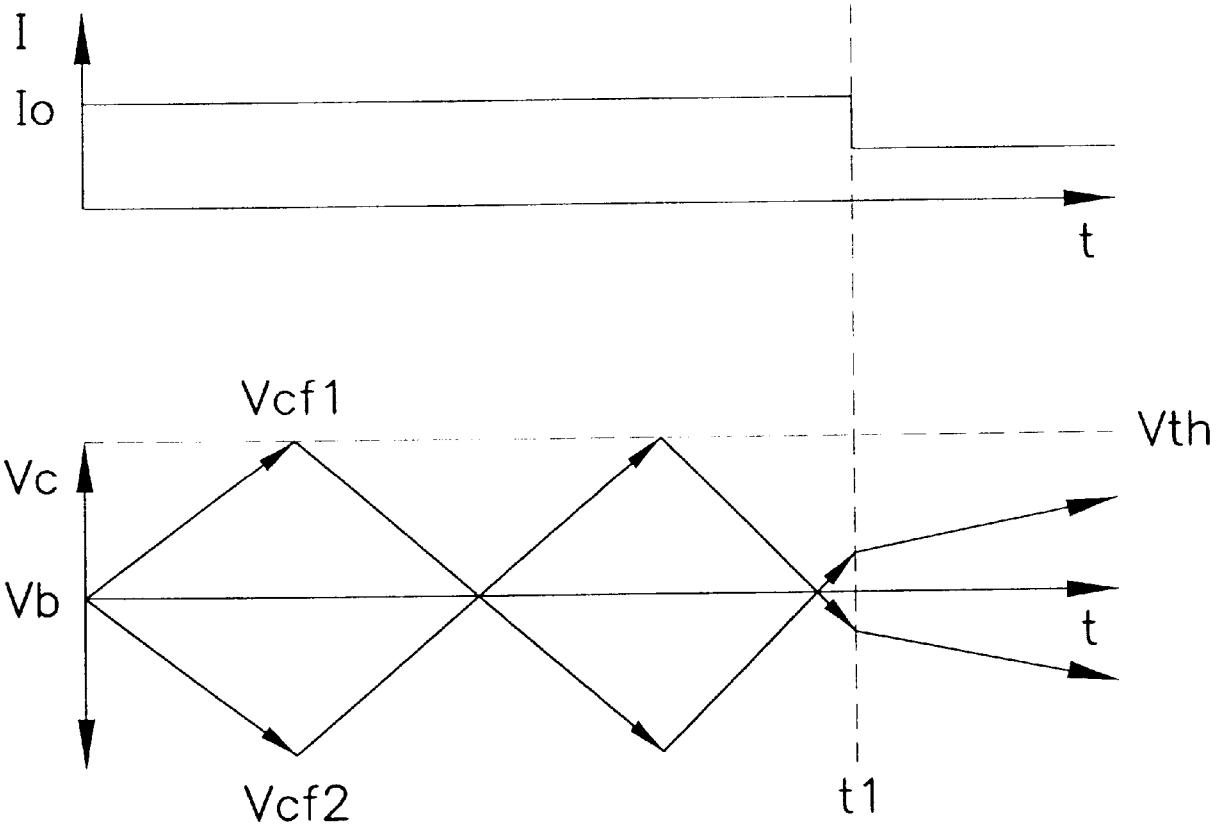
FIG. 4 is a graph showing the output of the integrator circuit of FIG. 3.

FIG. 4 shows the inverse relationship between Vout+ (Vcf2) and Vout− (Vcf1). In this scenario, the Φ2 switches 68*a–b* begin closed and the feedback capacitors 60*a–b* initially are discharged, so Vout+ and Vout− begin at Vb. When Io flows through the load 72, Vout+ and Vout− alternately and inversely ramp up and down in accordance with:

$$\frac{dV}{dt} = \frac{Io}{Cf}$$

When Io decreases at a time t1, this relationship ceases.

The integrator circuit 24 can effectively integrate forever (constantly flowing Io), with negligible glitching during phase switching. This lack of glitch is helped by the symmetry of input stage of the integrator circuit 24. Every input stage node 80*a–c* sees one switch 66*a–b*, 68*a–b* turn on and another turn off during a phase transition. The already low charge injection of the switches 66*a–b*, 68*a–b* is then effectively reduced to tens of femtoCoulombs (fC). Additionally, the symmetric pair requires no voltage drop across a switch 66*a–b*, 68*a–b*, aiding in keeping leakage currents below a picoAmp (pA). The voltages at the input stage nodes 80*a–c* are substantially the same.

Figure 5:
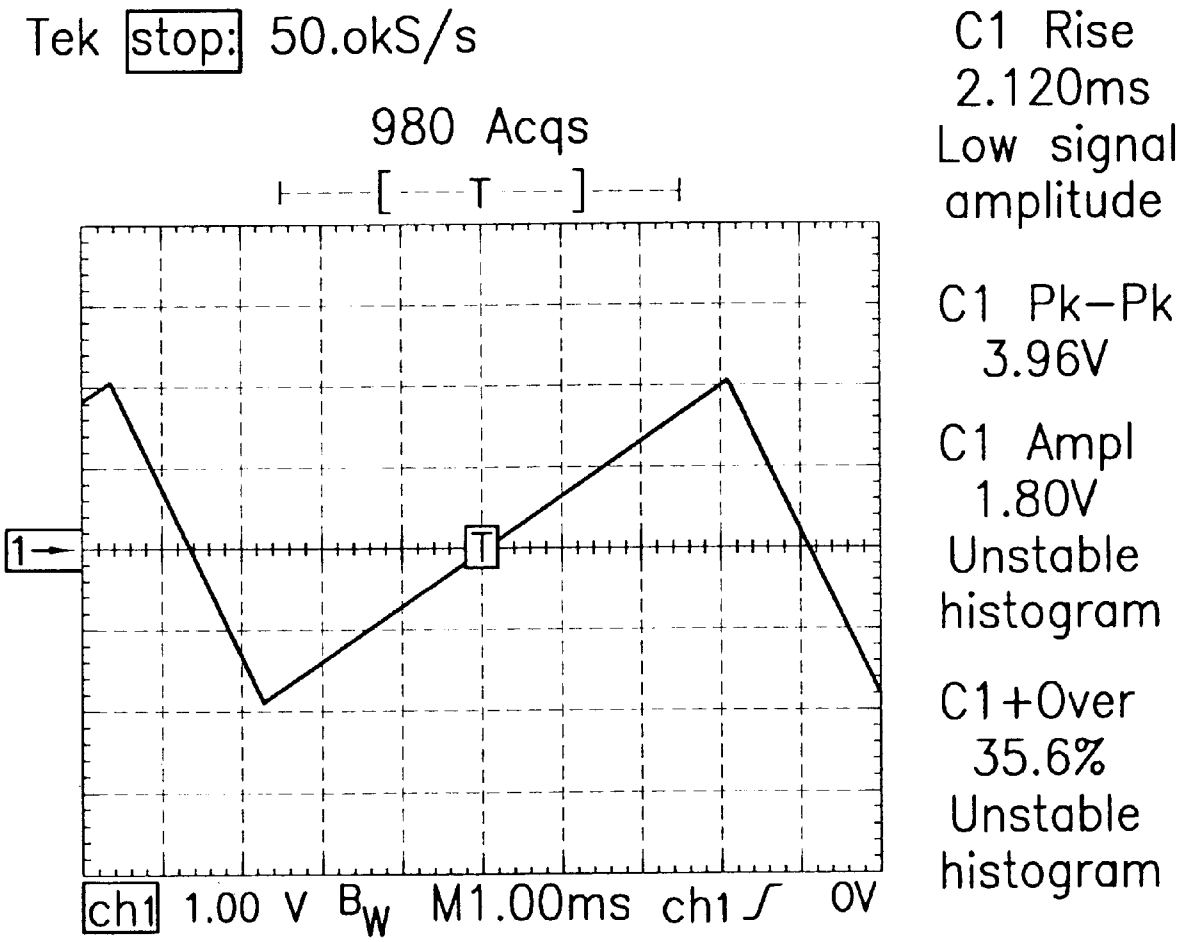
FIGS. 5–6 are graphs showing the chopper stabilization of the integrator circuit of FIG. 3.
Figure 6:
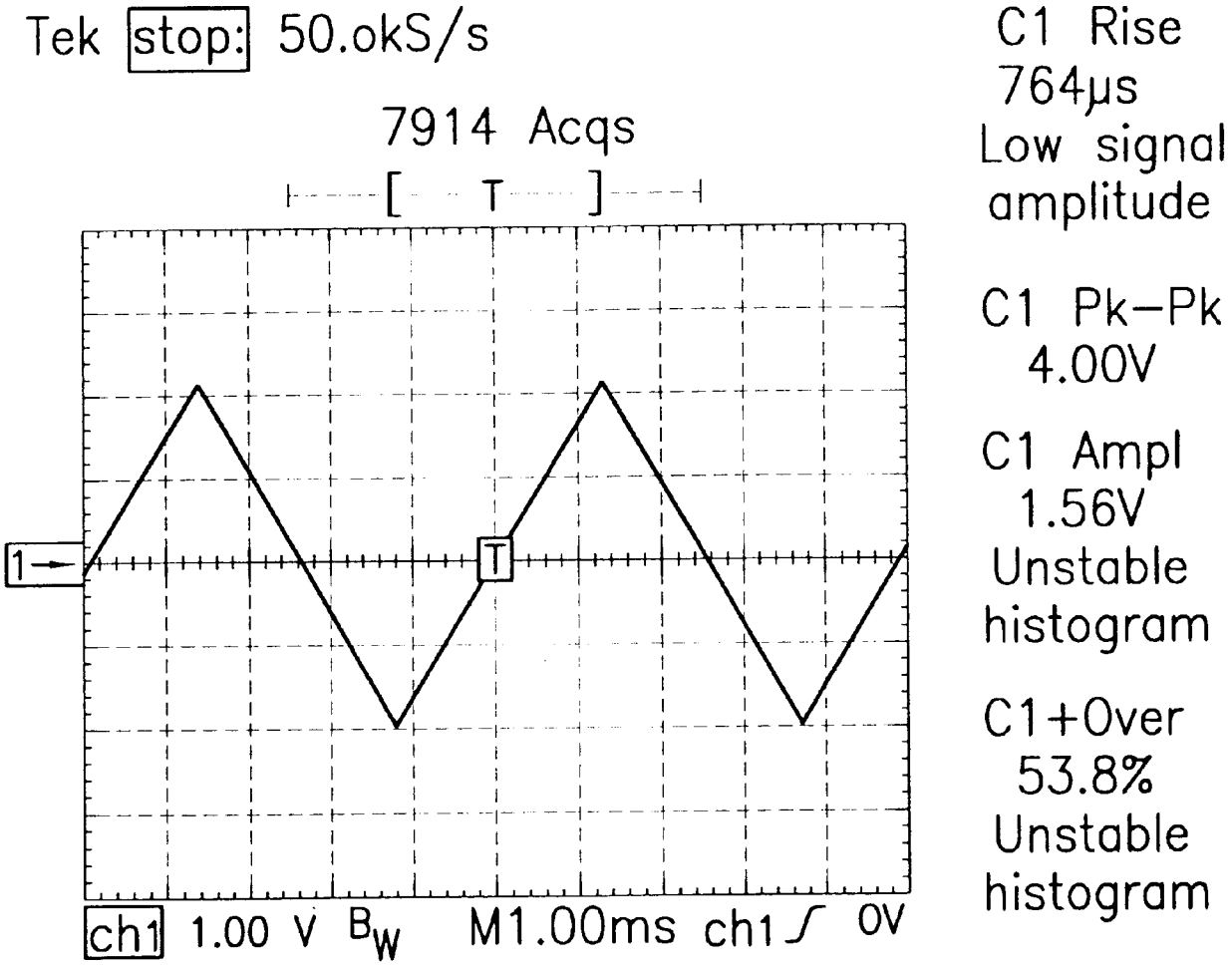

Referring to FIGS. 5 and 6, it is appreciated that offset may be a problem as in FIG. 5, but techniques exist to alleviate this problem, e.g., a stabilizing circuit. FIG. 5 shows the chop before stabilization, and FIG. 6 shows the chopper stabilization of the integrator circuit 24.

Figure 7:
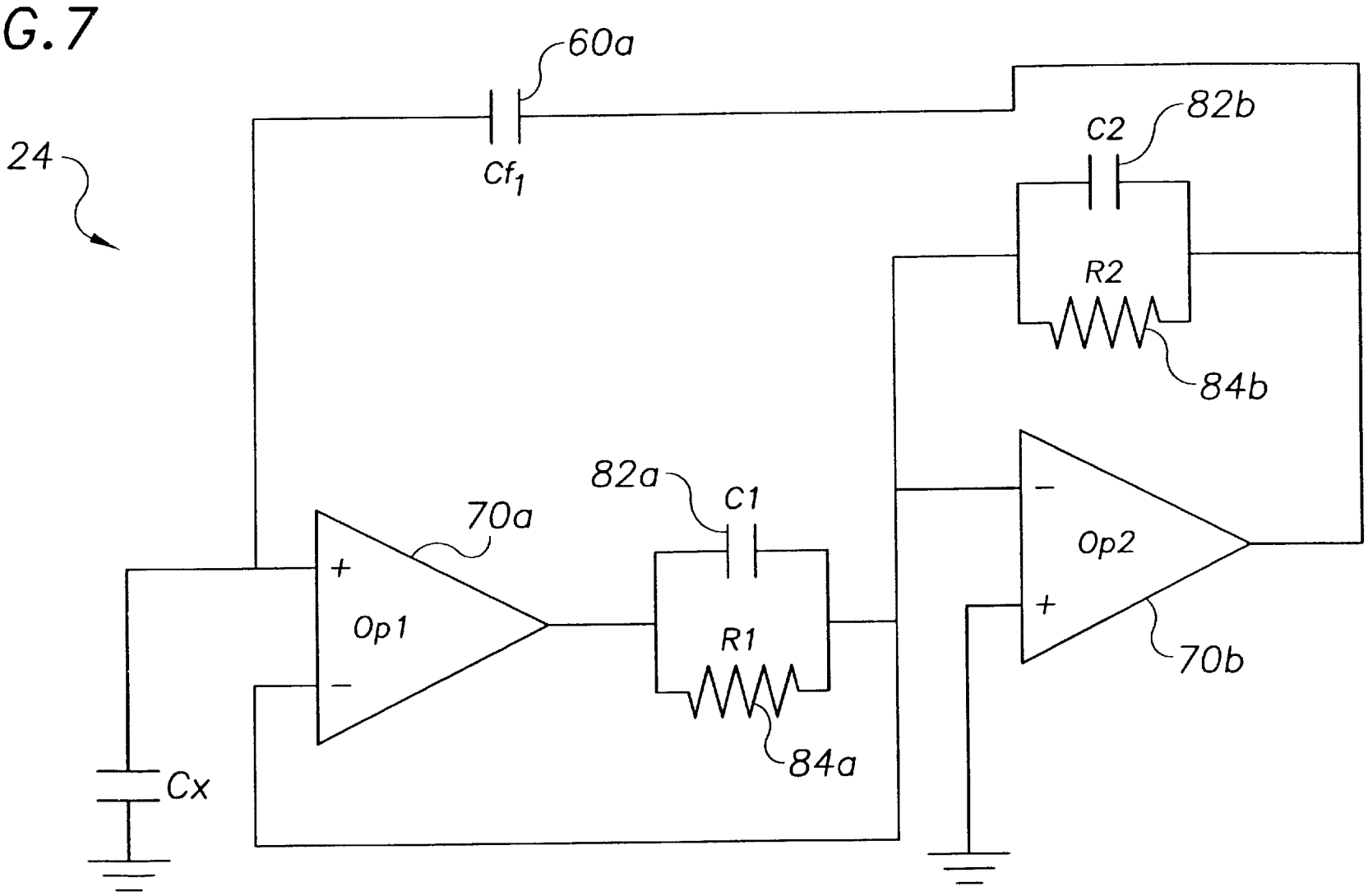
FIG. 7 is an unfolded view of the integrator circuit of FIG. 3.

Referring to FIG. 7, an unfolded view of the integrator circuit 24 helps demonstrate the manner in which the circuit functions. The compensation of the integrator circuit 24 may be broken down into two sections: minor and major loops. The minor loop concerns the stability of each opamp 70*a–b*; the major loop comprises the total feedback loop around the integrator. The major loop encompasses a unity gain inverter with a voltage divider formed by the first feedback capacitor 60*a* reacting with the capacitance off the input stage of the first opamp 70*a*. The input capacitance is dominated by the opamp input capacitance and the parasitics of the switches 66*a–b*, 68*a–b*. The ratio of the capacitive voltage divider in this embodiment is approximately ten, which will keep the major loop crossover well below that of the minor loops. The minor loops are stabilized with the addition of shunt capacitances 82*a–b*, which help compensate for phase lag due to shunt resistors 84*a–b* (preferably metal film) reacting with the input capacitance of the opamps 70*a–b*. With the bandwidth of the opamps 70*a–b* on the order of 10 MHz in this embodiment, the chopper stabilizing circuit 20 should be able to track currents with a bandwidth of approximately 1 MHz.

Figure 8:
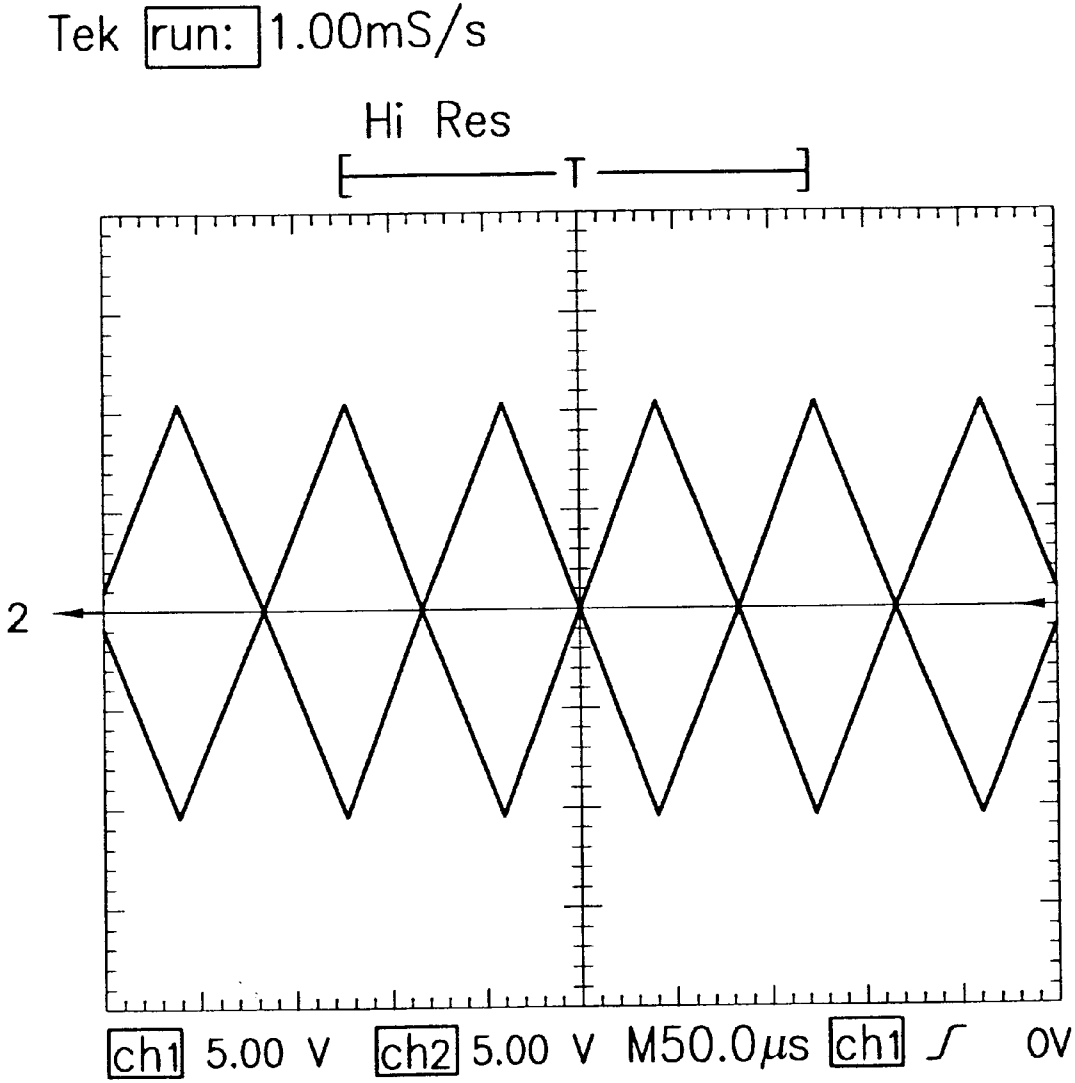
FIGS. 8–9 are graphs showing the output of the integrator circuit of FIG. 3.
Figure 9:
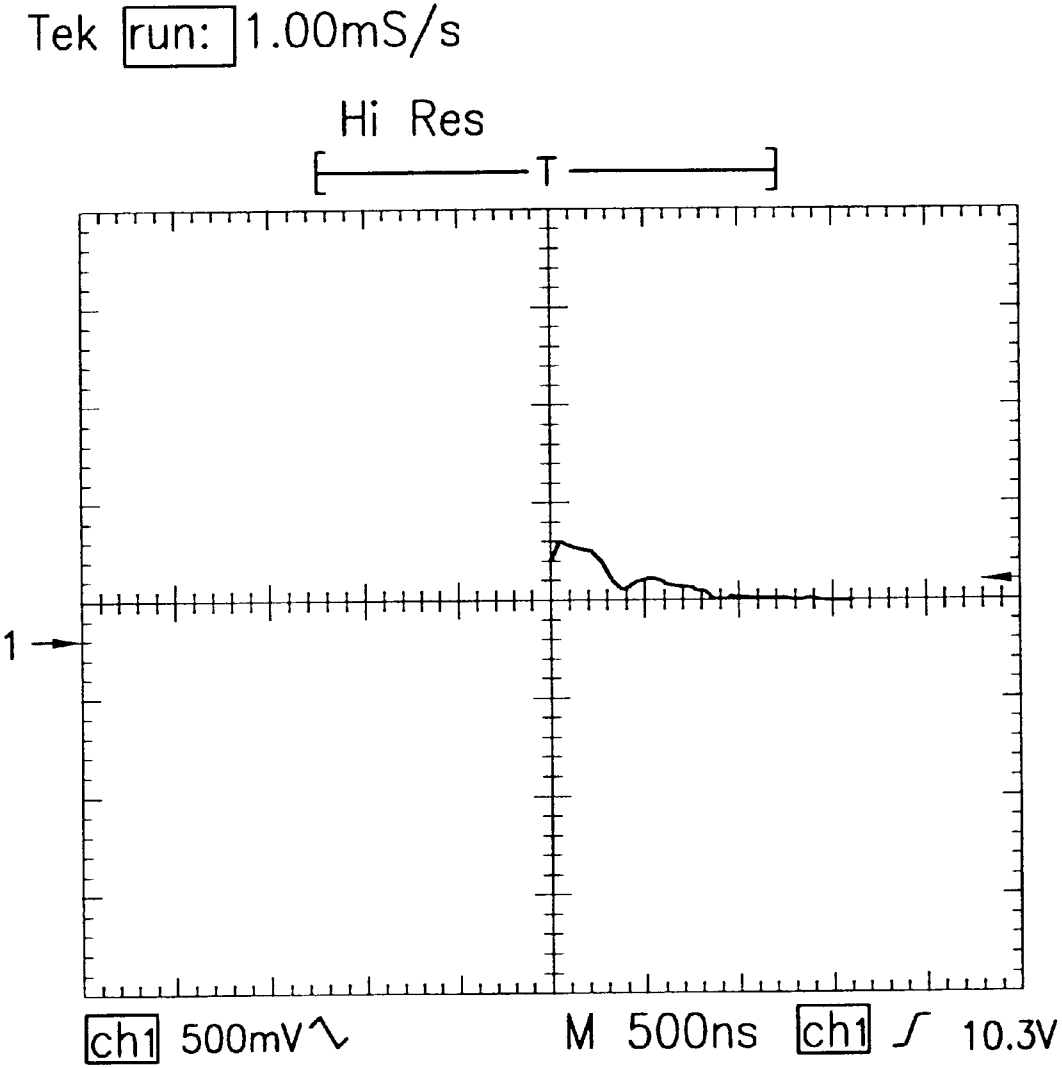
Figure 10:
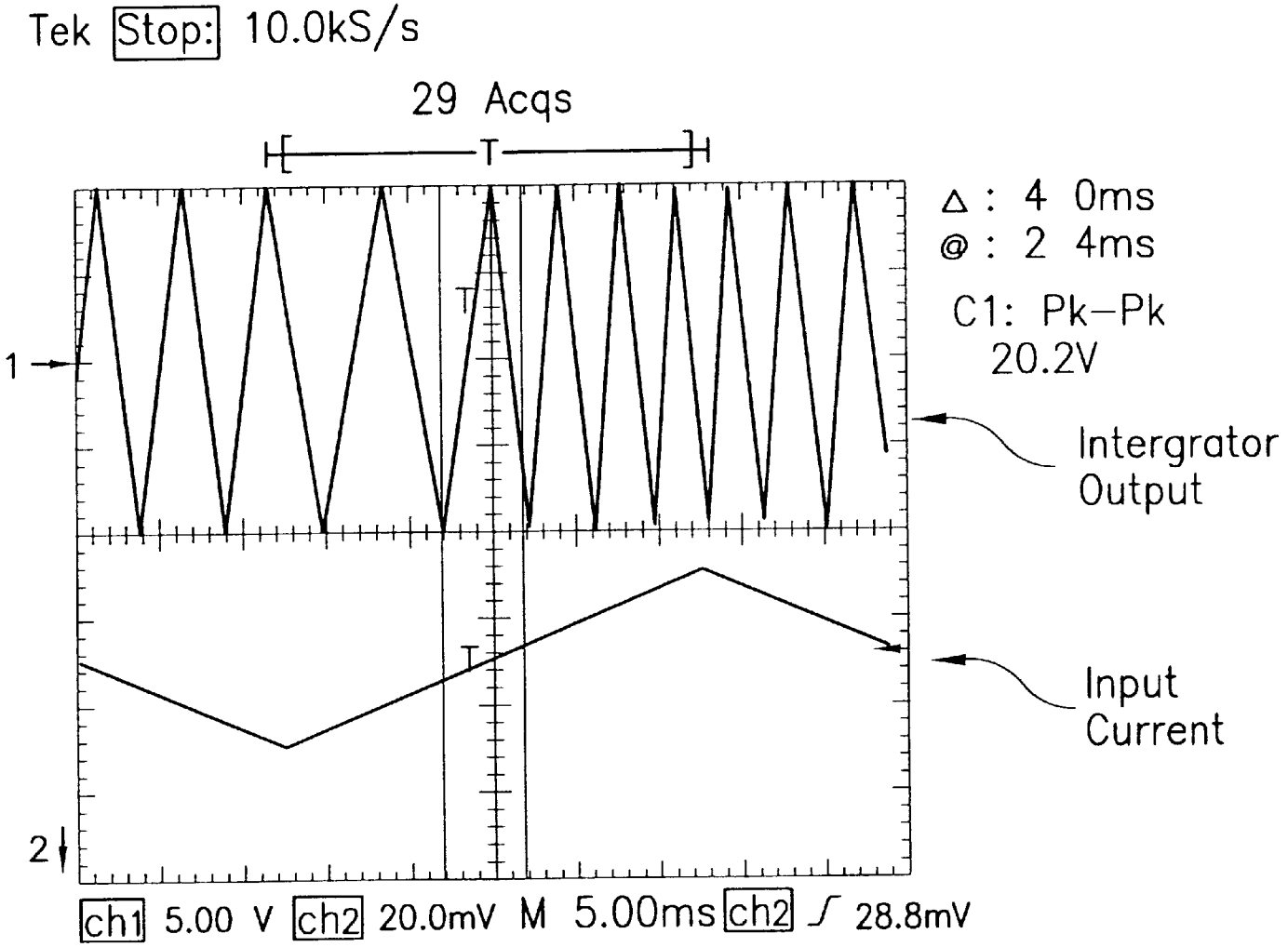
FIGS. 10–11 are graphs showing the response of the integrator of FIG. 3 to input current.
Figure 11:
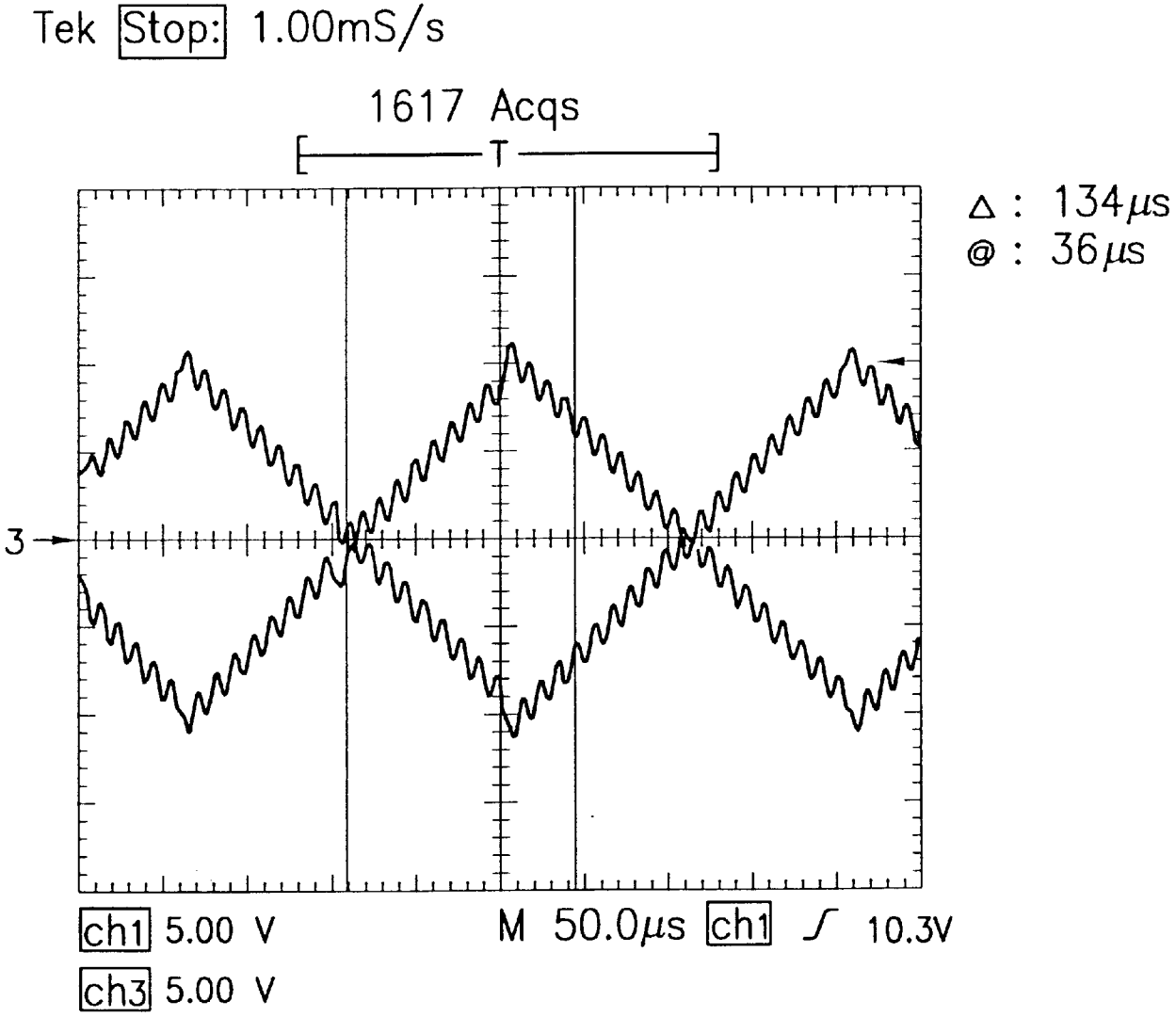
Figure 12:
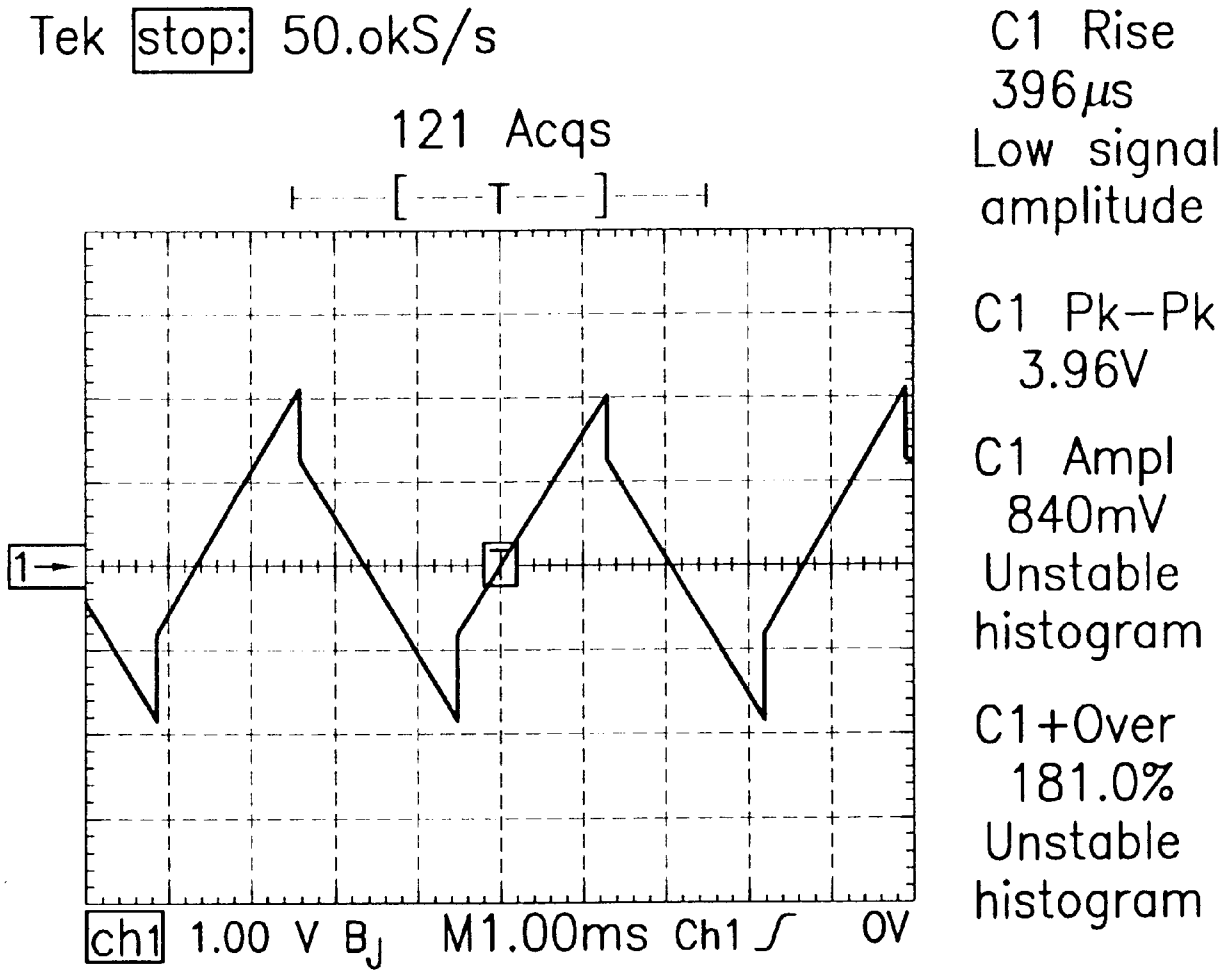
FIGS. 12–13 are graphs showing the charge injection compensation of the integrator circuit of FIG. 3.
Figure 13:
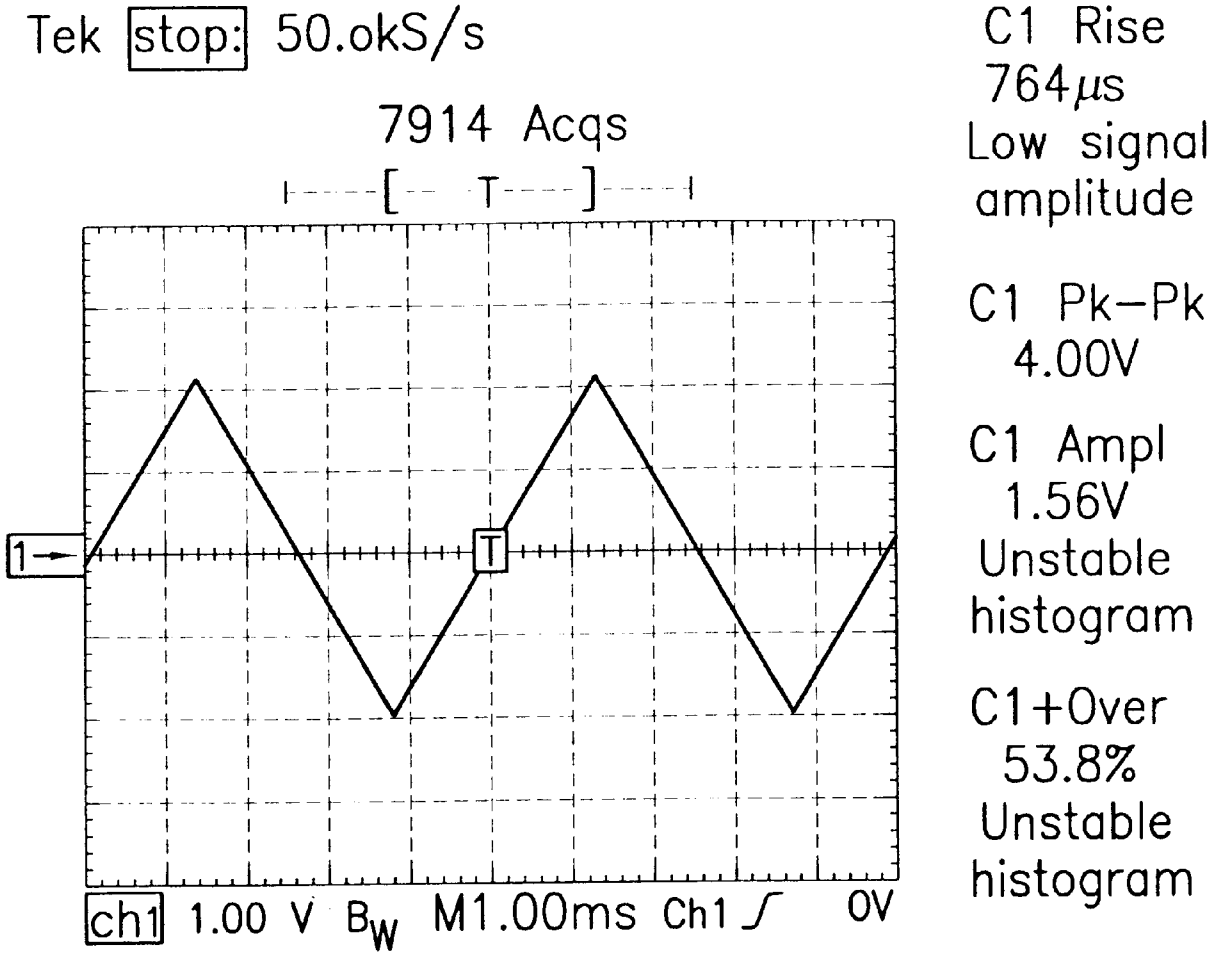

FIGS. 8–13 further demonstrate the functioning of the integrator circuit 24. FIG. 8 shows Vout+ and Vout− with 50 s per horizontal division, the typical reset duration in standard integrators, e.g., Axopatch 200B and nuclear physics instrumentation. FIG. 9 shows a zoom in on the reset transient, with the switching occurring of the order of 500 ns, e.g., 700 ns. The 2 pF feedback capacitor 60*a–b* and a residual voltage jump of 20 mV signifies under 40 fC of charge injection. FIG. 10 shows the response of the integrator circuit 24 (top trace) to input current (bottom trace), a 2 nA peak-to-peak triangle wave. Because of this response, the integrator circuit 24 could be used for direct digitization of input current via single-slope integration by measuring the period between resets. FIG. 11 shows the response of the integrator circuit 24 in FIG. 10 superimposed with a 100 kHz sinusoid supplied by a 2 pF capacitor at the input. FIG. 12 shows the charge injection before compensation, and FIG. 13 shows the charge injection after compensation by the integrator circuit 24.

Figure 14:
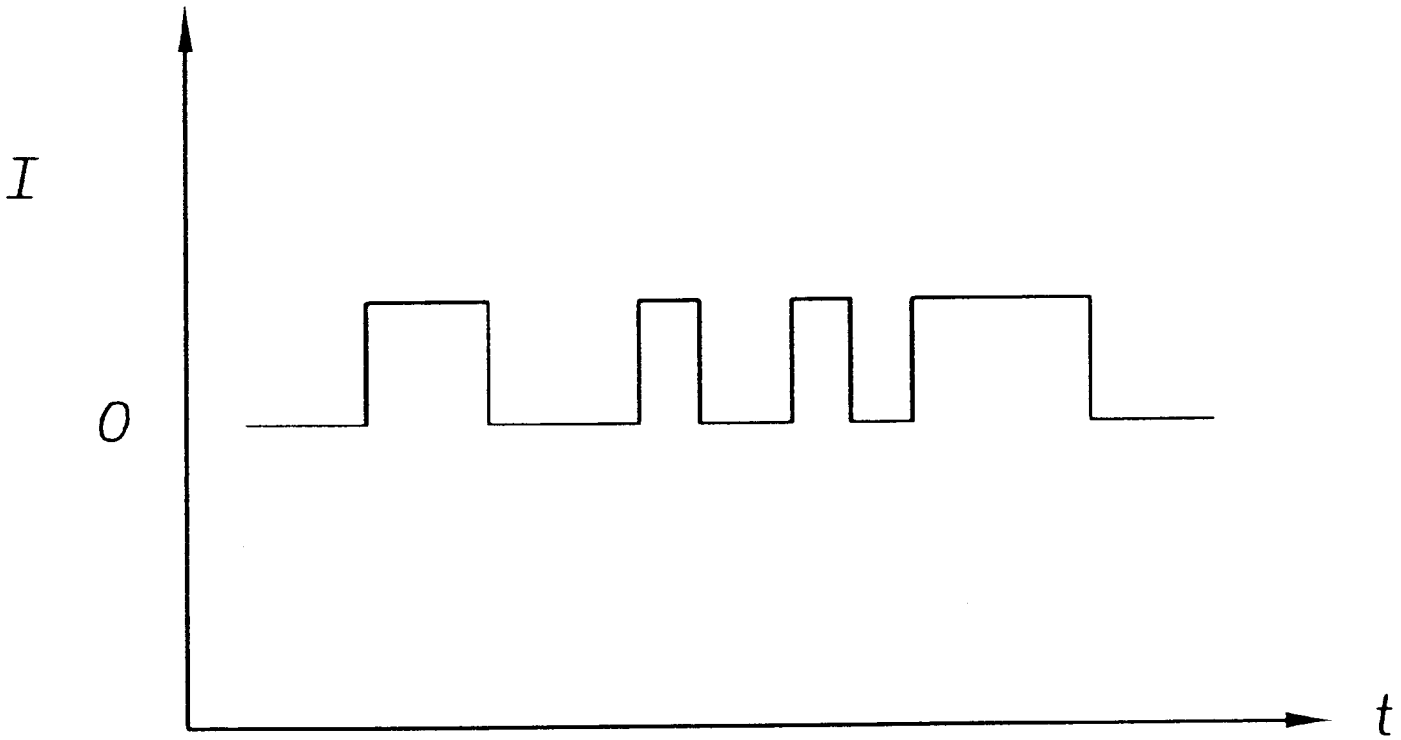
FIG. 14 is a graph showing currents detectable by the integrator circuit of FIG. 3.

Now referring to FIG. 14, the integrator circuit 24 can be used to detect the fluctuations of ion channels important in cell signaling and biological transport. These currents range from 0.1 pA to 100 pA, with bandwidths of 10 kHz. The integrator circuit 24 allows for measuring these currents without glitches from resetting.

Figure 15:
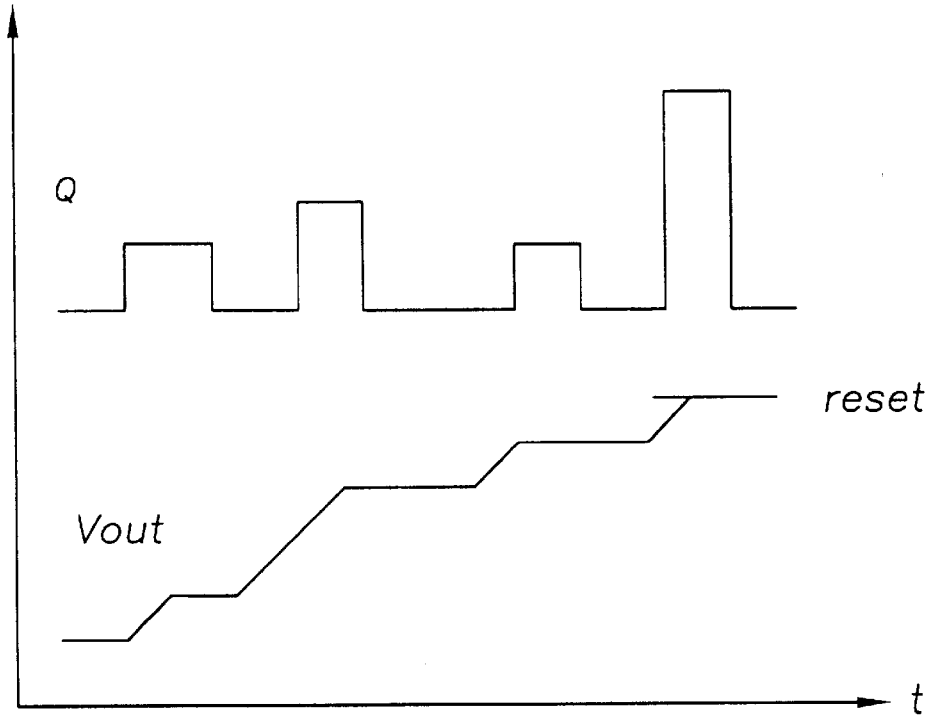
FIG. 15 is a graph showing charge detection by a conventional integrator circuit.
Figure 16:
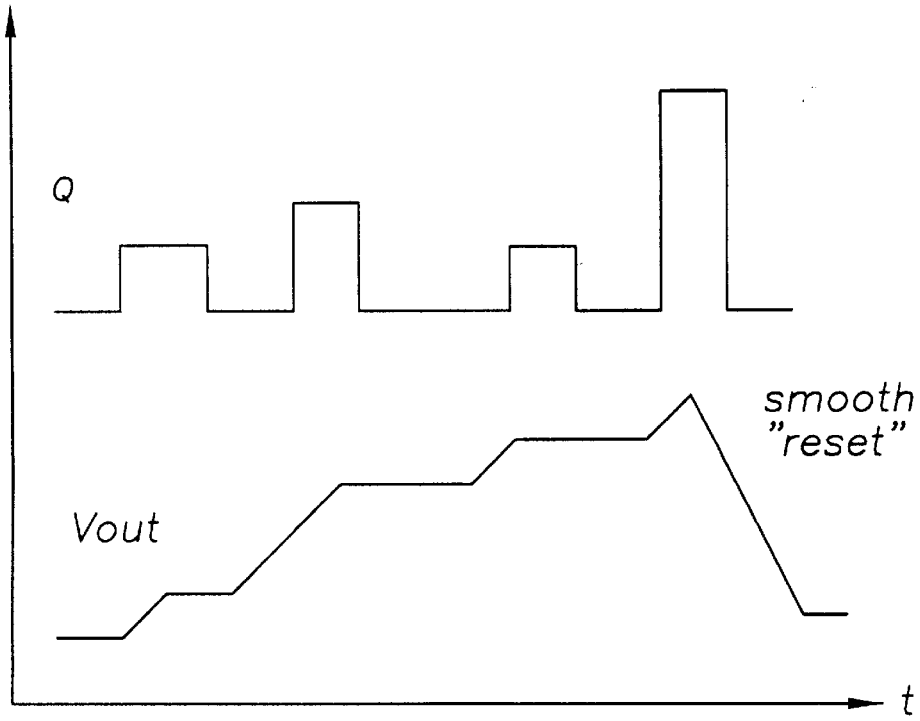
FIG. 16 is a graph showing charge detection by the integrator circuit of FIG. 3.

Now referring to FIGS. 15 and 16, the integrator circuit 24 can also be used for charge detection. For example, x-ray and particle detectors output charge pulses that are usually integrated. Whenever a conventional integrator hits a limit value as in FIG. 15, it must reset and data can be lost. Using the integrator circuit 24, the dead-time (lost data) is greatly reduced by the absence of capacitor resets as shown in FIG. 16.

Figure 17:
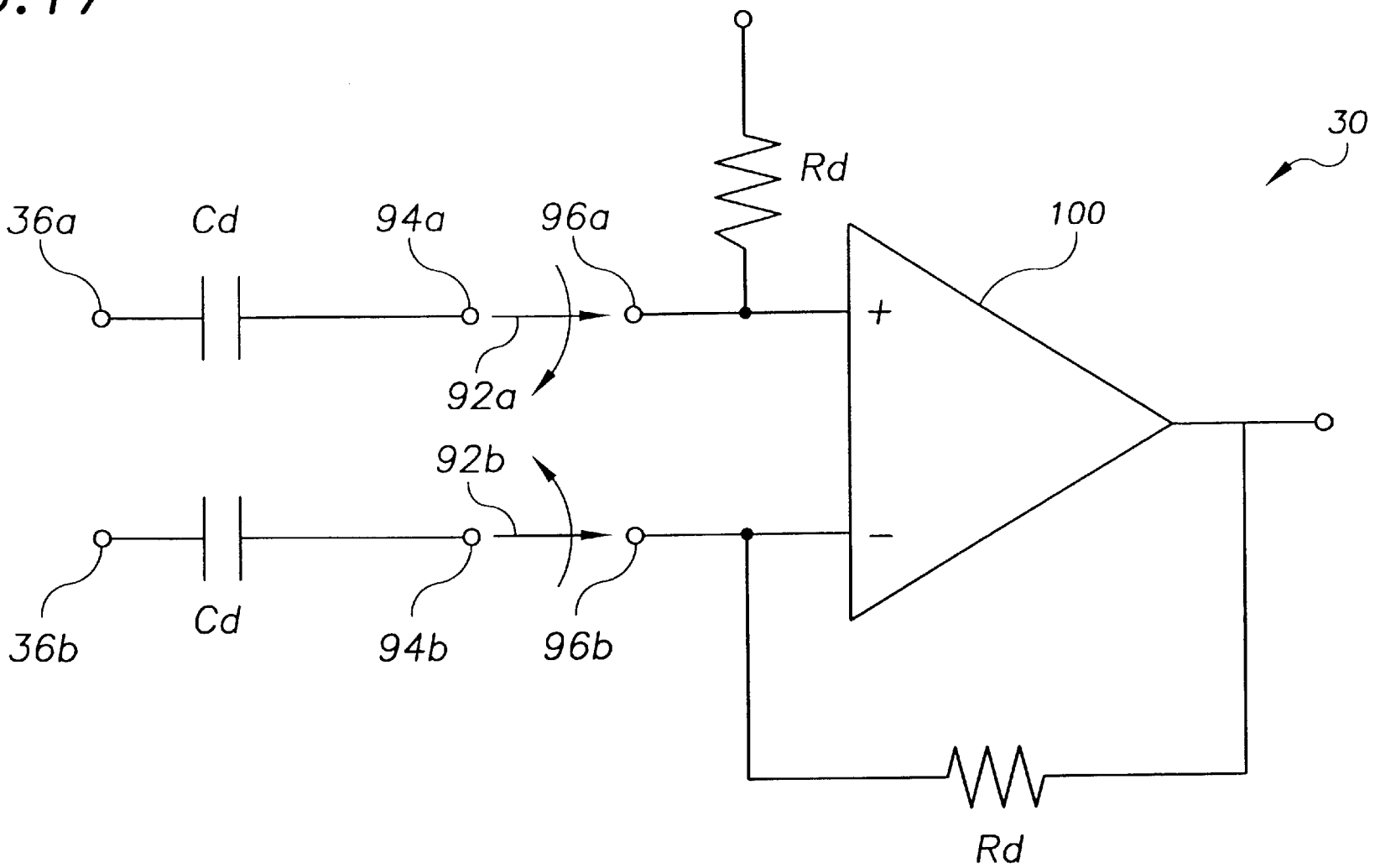
FIG. 17 is a schematic diagram of the differentiator circuit of FIG. 2.

A differentiator circuit 30, shown in FIG. 17, may be part of a chopper stabilizing circuit. The differentiator circuit 30 includes two switches 92*a–b*. The switches 92*a–b* may be any type of standard MOS (metal oxide semiconductor) switch, e.g., MAXIM 326. Each switch 92*a–b* is either in a horizontal (Φ1) position, e.g., switch 92*a* from a top start node 94*a* to a top end node 96*a*, or a diagonal (Φ2) position, e.g., switch 92*a* from the top start node 94*a* to a bottom end node 96*b*, at any given time. Each closed switch 92*a–b* provides a path for a signal at entering nodes 36*a–b* to travel to the inverting terminal or to the non-inverting terminal of an opamp 100. Input from a control circuit (not shown) determines the position of the switches 92*a–b*. If the differentiator circuit is connected to the chopper stabilizing circuit 20 (see FIG. 2), the output from the control circuit 78 provides the phase information for the switches 92*a–b*.

A number of embodiments of the invention have been described. Nevertheless, it will be understood that various modifications may be made without departing from the spirit and scope of the invention. Accordingly, other embodiments are within the scope of the following claims.

What is claimed is:

1. An apparatus, comprising:

a switching circuit having an output node determined by switch position;

an integrator circuit having a first input for receiving a first signal from the switching circuit output node and having a plurality of integrating feedback capacitors, each integrating capacitor connected to alternately charge and discharge, based on switch position, for continuous integrator circuit integration without integrator circuit reset;

a sensing circuit having a second input for receiving a second signal from the integrator circuit; and a control circuit having a third input for receiving a third signal from the sensing circuit and an output for sending a fourth signal to the switching circuit to control switch position for continuous integrator circuit integration.

2. The apparatus of claim 1 wherein the switching circuit includes two sets of two switches, each switch set having switch positions determining the switch output node by configuring the two switches in one set to be closed when the two switches in the other set are open, for controlling direction of the first signal to charge and discharge the integrating capacitors.

3. The apparatus of claim 2 wherein the switches are MOS devices.

4. The apparatus of claim 1 wherein the sensing circuit comprises a threshold detector.

5. The apparatus of claim 1 wherein the control circuit third input is connected for receiving the third signal from the sensing circuit for changing control circuit state, and wherein the fourth signal of the control circuit output indicates the control circuit state and controls position of switching circuit switches.

6. An apparatus, comprising:

a switching circuit;

an integrator circuit having a first input for receiving a first signal from the switching circuit and including a first integrator and a second integrator, the first integrator and the second integrator having connected inverting terminals, each of the first integrator and the second integrator having a non-inverting terminal connected to an output of the switching circuit, and each having an output, each output connected to the non-inverting terminal of the other integrator through a capacitor;

a sensing circuit having a second input for receiving a second signal from the integrator circuit; and a control circuit having a third input for receiving a third signal from the sensing circuit and an output for sending a forth signal to the switching circuit.

7. The apparatus of claim 6 wherein, in operation, the first integrator and the second integrator have voltages on respective ones of the inverting and non-inverting terminals which are substantially equal.

8. The apparatus of claim 6 wherein, in operation, the first integrator and the second integrator have output voltages which are complementary.

9. The apparatus of claim 6 wherein, in operation, the first integrator and the second integrator are each configured to introduce an output voltage into a chemical bath on either side of a biological membrane.

10. The apparatus of claim 6 wherein the integrator circuit is configured to detect fluctuations of ion channels.

11. The apparatus of claim 6 wherein the integrator circuit is configured for charge detection.

12. An apparatus comprising:

a switching circuit;

an integrator circuit having a first input for receiving a first signal from the switching circuit;

a sensing circuit having a second input for receiving a second signal from the integrator circuit and including two comparators, each comparator having an inverting terminal connected to the output of an integrator in the integrator circuit and each comparator having a non-inverting terminal connected to a threshold voltage; and a control circuit having a third input for receiving a third signal from the sensing circuit and an output for sending a fourth signal to the switching circuit.

13. An apparatus, comprising:

a switching circuit;

an integrator circuit having a first input for receiving a first signal from the switching circuit;

a sensing circuit having a second input for receiving a second signal from the integrator circuit; and a control circuit having a third input for receiving a third signal from the sensing circuit and an output for sending a fourth signal to the switching circuit, the control circuit including a D-type flip-flop and a NAND gate having an output connected to a clock terminal of the D-type flip-flop.

14. The apparatus of claim 13 wherein the NAND gate includes a pair of inputs, each connected to an output of a comparator in the sensing circuit.

15. The apparatus of claim 13 wherein the sensing circuit includes an output connected to the D-type flip-flop to change the state of the D-type flip-flop.

16. The apparatus of claim 13 wherein the D-type flip-flop includes high and low outputs which correspond to two switching positions of switches in the switching circuit.

17. An apparatus, comprising:

a switching circuit;

an integrator circuit having a first input for receiving a first signal from the switching circuit;

a sensing circuit having a second input for receiving a second signal from the integrator circuit;

a control circuit having a third input for receiving a third signal from the sensing circuit and an output for sending a fourth signal to the switching circuit; and a differentiator circuit having a fourth input for receiving a fifth signal from the integrator circuit and a fifth input for receiving a sixth signal from the control circuit.

18. The apparatus of claim 17 wherein the differentiator circuit includes an inverting terminal and a non-inverting terminal, each connected to an output of one of two integrators in the integrator circuit.

19. The apparatus of claim 18 wherein the control circuit provides the sixth signal which determines which output of which integrator in the integrator circuit that each inverting and non-inverting terminal connects to.

20. An apparatus, comprising:

a switching circuit having a plurality of switch positions configured to deliver an input current from a load to a switching circuit output node;

an integrator circuit having two integrators connected at a first input to alternately receive the load input current from the switching circuit output node, based on switch position, for continuous integrator circuit integration without integrator circuit reset;

a sensing circuit having a second input for receiving a second signal from the integrator circuit; and a control circuit having a third input for receiving a third signal from the sensing circuit and an output for sending a fourth signal to the switching circuit to control switch position for continuous integrator circuit integration.

21. The apparatus of claim 20 further comprising a voltage source connected to switch positions of the switching circuit to alternate a voltage bias between the two integrators of the integrator circuit, based on switch position, as the load input current is alternately received by the two integrators.

22. The apparatus of claim 20 wherein each integrator of the integrator circuit includes a corresponding feedback capacitor, the two integrators being connected at the integrator circuit first input for charging one feedback capacitor while discharging the other feedback capacitor, based on switch position.

23. The apparatus of claim 20 wherein the integrator circuit first input connection to the two integrators is configured with respect to the switching circuit output node to preserve a uniform load bias and input current orientation through a load for any switching circuit switch position.

24. The apparatus of claim 20 wherein the integrator circuit first input connection to the two integrators is configured with respect to the switching circuit output node to maintain a constant flow of load input current for any switching circuit switch position.

25. The apparatus of claim 20 wherein the second signal from the integrator circuit comprises a continuous flow of two complementary voltages.

* * * * *